United States Patent [19]

Mose et al.

[11] 4,207,165

[45] Jun. 10, 1980

[54] FILTER PRESS CELL

[75] Inventors: Luciano Mose, Dortmund; Helmut Schurig, Holzwickede; Bernd Strasser, Hamm, all of Fed. Rep. of Germany

[73] Assignee: Hooker Chemicals & Plastics Corp., Niagara Falls, N.Y.

[21] Appl. No.: 39,992

[22] Filed: May 17, 1979

[30] Foreign Application Priority Data

May 19, 1978 [DE] Fed. Rep. of Germany ..... 2821981

[51] Int. Cl.[2] ..... C25B 9/00; C25B 13/02; C25B 13/04

[52] U.S. Cl. ..... 204/258; 204/266; 204/279

[58] Field of Search ..... 204/257-258, 204/263-266, 279

[56] References Cited

U.S. PATENT DOCUMENTS

| | | | |
|---|---|---|---|
| 4,013,535 | 3/1977 | White | 204/258 X |
| 4,026,782 | 5/1977 | Bouy et al. | 204/279 X |
| 4,076,609 | 2/1978 | Mas | 204/279 X |
| 4,129,495 | 12/1978 | Fitch et al. | 204/279 |

FOREIGN PATENT DOCUMENTS

| | | | |
|---|---|---|---|
| 2827360 | 1/1979 | Fed. Rep. of Germany | 204/279 |

*Primary Examiner*—John H. Mack
*Assistant Examiner*—D. R. Valentine
*Attorney, Agent, or Firm*—Peter F. Casella; Howard M. Ellis

[57] ABSTRACT

An improved electrolytic cell of the filter press type in which the electrode gap may initially be set and accurately maintained during assembly of the cell units is described. The cell units consist of a planar anode mounted in a peripheral anode frame, a planar cathode mounted in a peripheral cathode frame, a barrier, such as a diaphragm or membrane, positioned between the anode and cathode, a spacer member and at least one gasket member positioned between the edges of the anode and cathode frames. The total gasket width in an uncompressed state is greater than the thickness of the spacer member. Upon assembly of the unit, the gasket member is compressed forming a gas and liquid seal. The thickness of the spacer member determines the space between the anode and cathode frame members and, consequently, the space or gap between the anodes and cathodes mounted in the frame members.

7 Claims, 2 Drawing Figures

FILTER PRESS CELL

BACKGROUND OF THE INVENTION

The present invention relates to the construction of improved electrolytic cells useful as units of a filter press cell arrangement. The present cells are particularly useful in the electrolysis of alkali metal chlorides, such as sodium chloride, to produce alkali metal hydroxides, such as sodium hydroxide, together with chlorine and hydrogen.

A filter press arrangement typically consists of a plurality of separate cell units having planar electrode elements generally mounted in a vertical position separated along their active faces by a barrier, such as a diaphragm or membrane layer. The filter press cell units may be monopolar or bipolar and may be appropriately connected in series or parallel to form a circuit or cell bank.

Chlorine and alkali metal hydroxides are essential and large volume commodities as basic industrial chemicals. Plants producing 500 to 1000 tons of chlorine per day are not uncommon. Such plants typically utilize a large number of individual electrolytic cells having current capacities of several hundred thousand amperes. Thus, minor improvements in individual cell operation or performance have major economic benefits because of the volume of the products produced.

Upon the application of direct, electrolyzing current to an electrolytic cell containing an aqueous solution of an alkali metal chloride as the electrolyte, hydrogen and alkali metal hydroxide are produced at the cathode and chlorine is produced at the anode.

Electrolytic cells that are commonly employed commercially for the conversion of alkali metal halides into alkali metal hydroxides and halides may be considered to fall into the following general types: (1) diaphragm, (2) mercury and (3) membrane cells.

Diaphragm cells utilize one or more diaphragms permeable to the flow of electrolyte solution but impervious to the flow of gas bubbles. The diaphragm separates the cell into two or more compartments. Although diaphragm cells achieve relatively high product per unit floor space, at low energy requirements and at generally high current efficiency, the alkali metal hydroxide product, or cell liquor, must be concentrated and purified. Such concentration and purification is usually accomplished by a subsequent evaporation step.

Mercury cells typically utilize a moving or flowing bed of mercury as the cathode and produce an alkali metal amalgam in the mercury cathode. Halide gas is produced at the anode. The amalgam is withdrawn from the cell and treated with water to produce a high purity alkali metal hydroxide.

Membrane cells utilize one or more membranes or barriers separating the catholyte and the anolyte compartments. The membranes are permselective, that is, they are selectively permeable to either anions and cations. Generally, the permselective membranes utilized are cationically permselective. Usually, the catholyte product of the membrane cell is a relatively high purity alkali metal hydroxide ranging in concentration from about 250 to about 350 grams per liter.

The advent of dimensionally stable anodes has permitted even narrowing of the space, or gap, between the electrodes of a cell, thereby facilitating progressively higher cell efficiency. In the operation of circuits or banks of electrolytic cells, it is advantageous to have the electrode gap uniform in order that the circuit be balanced.

Circuits or banks of filter press cells are formed by the assembly of individual cell components. For example, in the case of a monopolar arrangement, the components typically would comprise a plurality of anodes mounted in anode frames and cathodes mounted in cathode frames. The anodes and cathodes are separated along their active faces by a permeable barrier, such as a diaphragm or membrane, and along the inner periphery of the frames by a pliable or elastic gasket member. The assembly is completed by coupling or pressing the components together, hydraulically or by means of threaded connectors, to compress the gasket members to form gas and liquid-tight seals between the individual units. Because of the differences in gasket materials and the required compression sufficient to obtain a gas and liquid-tight seal, it has heretofore been a difficult task to obtain and to maintain a desired electrode gap in a filter press arrangement.

GENERAL DESCRIPTION OF THE INVENTION

The present invention provides an electrolytic cell of the filter press type in which the electrode gap may initially be set and accurately maintained while a gas and liquid-tight seal between components is obtained.

The present individual cell unit is comprised of a planar anode mounted in a peripheral anode frame member and a planar cathode mounted in a peripheral cathode frame member. A layer of permeable barrier material, for example, asbestos or a permselective membrane material, is positioned between the active faces of the anode and cathode members. Suitably, the barrier material is positioned contiguous the active face of the cathode member. While the frame and electrode members may be of any configuration, for ease of fabrication and replacement in a circuit, such members are usually fabricated in the shape of a square or rectangle.

The present anode and cathode frame members are separated by a spacer member positioned between the frame members contiguous to the outer portions of the sides thereof and by at least one separate hollow gasket member positioned between the frame members contiguous to the inner portions of the sides thereof. The hollow gasket member or members have an initial uncompressed thickness greater than the thickness of the spacer member so that, when the cell components are assembled and compressed, a gas and liquid-tight seal is formed between each of the frame members. To avoid joints and possible leakage, each gasket member is preferably formed of a single tubular piece and is in the configuration of a frame member. The spacer member is preferably in the form of a frame, but may be fabricated of separate bars or strips positioned between at least two of the sides of the anode and cathode frame members.

The present cell is assembled by known means to couple the individual cell units together to form gas and liquid seals between each unit. The units may suitably be assembled by being compressed by hydraulic means or by means of threaded connectors. The present frame members are equipped with appropriate vents and ports to facilitate the addition of an electrolyte and for removal of the electrolysis products. Suitable electrical connections are provided with the electrodes, depending upon whether the cell is monopolar or bipolar, to supply the required electrolyzing or decomposing current to the cell.

DETAILED DESCRIPTION OF THE INVENTION

The present invention will now be explained in detail by reference to the attached drawings. The drawings are illustrative of the present invention and are not to be construed as limiting the invention to the particular modes illustrated.

Figure 1:
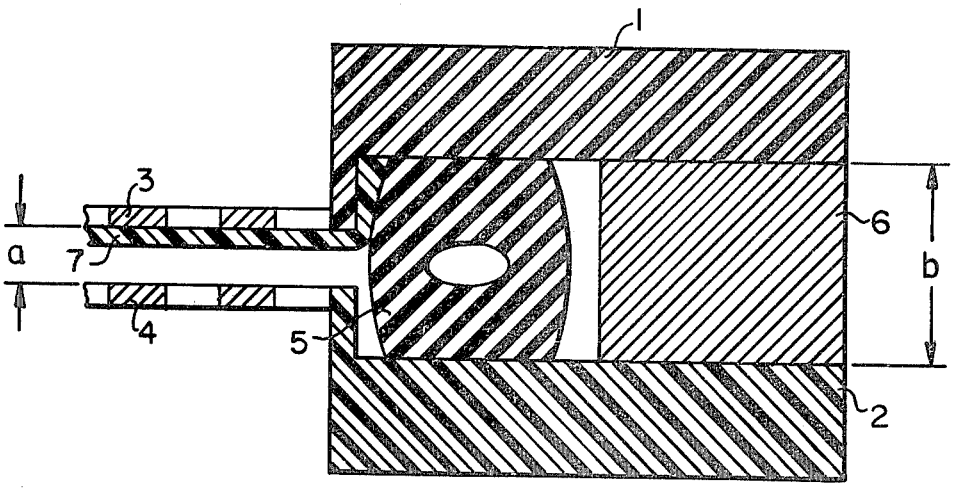
Figure 2:
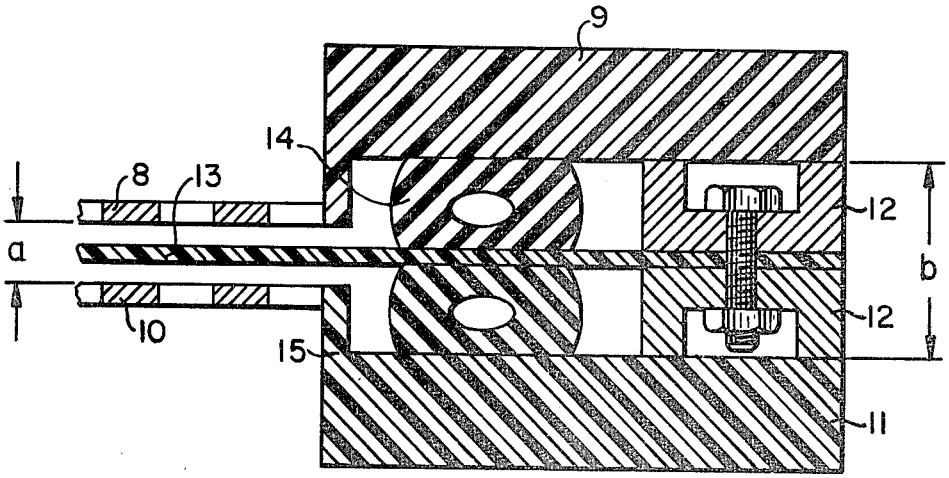

FIG. 1 is a partial, sectional and elevational view of a pair of electrode frame members in a diaphragm type cell, and FIG. 2 is a partial, sectional and elevational view of a pair of electrode frame members in a membrane type cell.

Looking now at FIG. 1, planar cathode 3 is mounted in peripheral cathode frame member 1. Planar anode 4 is mounted in peripheral anode frame member 2. Cathode frame member 1 is spaced from anode frame member 2 by spacer member 6. Hollow gasket member 5 is positioned between frame members 1 and 2 and, when compressed to the thickness of spacer member 6, effectively provides a gas and liquid-tight seal between the frame members.

Cathode member 3 is suitably fabricated of steel; however, chromium, cobalt, copper, iron, lead, molybdenum, nickel, tin, tungsten or alloys thereof also can be used. Cathode member 3 may be foraminous or may be in the form of a sheet or plate.

Anode member 4 may also be foraminous or in the form of a sheet or plate. Anode member 4 is preferably fabricated from a valve metal base which has an electrically-conductive, anodically-resistant coating applied to its active anodic or unoxidized surface. Suitable valve metals include titanium, tantalum, niobium and zirconium. The preferred valve metal is titanium. The coating preferably contains one or more platinum-group metals, and/or platinum-group metal oxides. Suitable platinum-group metals include platinum, ruthenium, rhodium, palladium, osmium and iridium. Any of various methods can be used for applying the coating to the valve metal base. Typical methods include precipitation of the metals or metallic oxides by chemical, thermal or electrolytic processes, ion plating, vapor deposition or the like means.

Cathode frame member 1, anode frame member 2 and spacer 6 may be conductive, for example, metallic, or non-conductive, provided all are not conductive. Non-conductive plastic materials which are resistant to corrosion by the electrolyte and can withstand the operating temperatures of the cell can be used. Examples of such suitable materials are various thermoplastic or thermosetting resins, such as polypropylene, polybutylene, polytetrafluoroethylene, after chlorinated or rigid FEP, chlorendic acid based polyesters, and the like.

Hollow gasket member 5 is suitably fabricated of Neoprene, or other chloroprene rubbers, Teflon, or other fluorocarbon resins, or the like. In a preferred embodiment, gasket member 5 is fabricated of a single piece of tubing and is in the form of a frame.

A layer of diaphragm material 7 is deposited on the active face of cathode 3. Suitably, the diaphragm material is asbestos.

Spacer member 6 may be utilized in the form of bars or strips positioned between the anode and cathode frames; however, it is preferred that spacer member 6 be in the form of a frame and extend between all sides of the anode and cathode frames.

The desired gap, a, between cathode 3 and anode 4 is predetermined. The desired gap is obtained in the assembled cell by selecting a spacer member 6 with the appropriate thickness, b. Upon assembly and compression, the thickness of spacer member 6 determines the distance between anode and cathode frame members 1 and 2, and in turn between the active face of cathode 3 and anode 4.

Looking now at FIG. 2, this figure shows an electrolytic cell similar to FIG. 1, except the cell in FIG. 2 is equipped with a permselective membrane. Planar cathode 8 is mounted in peripheral cathode frame member 9. Planar anode 10 is mounted in peripheral anode frame member 11. Cathode frame member 9 is spaced from anode frame member 11 by spacer member 12. The active face of cathode 8 and the active face of anode 10 are separated by a permselective membrane 13. Hollow gasket members 14 and 15 are positioned between frame 9 and frame 11 and on opposite sides of membrane 13. Hollow gasket members 14 and 15 have a combined or total thickness greater than spacer member 12 so that, when the unit is compressed to the thickness of spacer member 12, gasket members 14 and 15 provide an effective gas and liquid seal between the frame members. In the modification shown in FIG. 2, spacer member 12 is shown as a separable assembly to facilitate a secure anchoring of membrane 13. In such mode, spacer member 12 may suitably be utilized in the form of a frame member having membrane 13 mounted therein.

Suitable membrane may be fabricated of a hydrolyzed copolymer of a perfluorinated hydrocarbon and a sulfonated perfluorovinyl ether. More specifically, such suitable membrane materials are fabricated of a hydrolyzed copolymer of tetrafluoroethylene and a fluorosulfonated perfluorovinyl ether of the formula: $FSO_2CF_2CF_2OCF(CF_3)CF_2OCF{=}CF_2$. Usually, the membrane wall thickness will range from about 0.02 to about 0.5 mm., and preferably, from about 0.1 to about 0.3 mm. When mounted on polytetrafluoroethylene, asbestos or other suitable network for support, the network filaments or fibers will generally have a thickness of from about 0.01 to about 0.5 mm., and, preferably, from about 0.05 to about 0.15 mm.

While there have been described various embodiments of the invention, the apparatus described is not intended to be understood as limiting the scope of the invention as it is realized that changes therewithin are possible are possible, and it is intended that each element recited in any of the following claims is to be understood as referring to all equivalent elements for accomplishing the same results in substantially the same or equivalent manner, it being intended to cover the invention broadly in whatever form its principle may be utilized.

What is claimed is:

1. An electrolytic cell comprising:

(a) a planar anode mounted in a peripheral frame member, the sides of said frame member having an inner and an outer portion, (b) a planar cathode mounted in a peripheral frame member, the sides of said frame member having an inner and an outer portion, (c) a permeable barrier positioned between said anode and said cathode, (d) a spacer member positioned between said frame members contiguous their said outer portions, (e) at least one hollow gasket member positioned between said frame members contiguous their said inner portions, said hollow gasket members having a total width in the uncompressed state greater than the width of said spacer member, (f) means for compressing and holding said frame members in a coupled state forming a cell unit, (g) means for adding electrolyte and removing electrolysis products from said cell unit, and (h) means for connecting said anode and said cathode members to a source of electrolyzing current.

2. The cell of claim 1 wherein the spacer member is in the form of a frame.

3. The cell of claim 1 wherein the barrier material is asbestos.

4. The cell of claim 1 wherein the barrier material is a permselective membrane.

5. The cell of claim 4 wherein the spacer member is in the form of a frame in which the permselective membrane is mounted.

6. The cell of claim 1 wherein the spacer member is fabricated of a non-conductive plastic.

7. The cell of claim 1 wherein the spacer member is metallic and at least one of said anode and cathode frame members is fabricated of a non-conductive plastic.

* * * * *